United States Patent [19]

Derail et al.

[11] 4,059,948

[45] Nov. 29, 1977

[54] AUTOMATIC THREADING FALSE-TWIST SPINDLE

[75] Inventors: Yves C. Derail, La Murette-Ambierle; Jean-Claude Dupeuble, Roanne, both of France

[73] Assignees: ASA S.A., Roanne, France; Societa Nazionale Industria Applicazioni Viscosa S.p.A., Milan, Italy

[21] Appl. No.: 688,791

[22] Filed: May 21, 1976 (Under 37 CFR 1.47)

[30] Foreign Application Priority Data

May 23, 1975 France ..... 75.16736

[51] Int. Cl.[2] ..... D01H 7/92

[52] U.S. Cl. ..... 57/77.33; 57/77.4; 57/156

[58] Field of Search ..... 57/34 R, 51.5, 77.33, 57/77.4, 106, 156

[56] References Cited

U.S. PATENT DOCUMENTS

| | | | |
|---|---|---|---|
| 1,962,265 | 6/1934 | Wenzel | 57/77.33 X |
| 3,605,396 | 9/1971 | Guignaul et al. | 57/106 |
| 3,819,099 | 6/1974 | Bierenfeld | 57/34 R X |
| 3,822,539 | 7/1974 | Heap et al. | 57/77.33 X |
| 3,872,661 | 3/1975 | Eaves | 57/77.4 |

FOREIGN PATENT DOCUMENTS

| | | | |
|---|---|---|---|
| 2,213,147 | 10/1973 | Germany | 57/77.4 |

*Primary Examiner*—Richard C. Queisser
*Assistant Examiner*—Charles Gorenstein
*Attorney, Agent, or Firm*—Arnold, White & Durkee

[57] ABSTRACT

A false-twist texturing spindle in which the yarn to be twisted may be automatically threaded in the spindle through a retractable tube that is longitudinally movable between the rollers or discs of the spindle, on an axis coincident with the axis of thread travel. The retractable tube is movable from an inoperative spindle mode, allowing yarn threading, to an operative spindle mode after threading, for yarn twisting.

14 Claims, 5 Drawing Figures

AUTOMATIC THREADING FALSE-TWIST SPINDLE

BACKGROUND OF THE INVENTION

This invention relates to an apparatus for false-twisting synthetic yarns, more particularly, a disc clutch false-twist texturing spindle whereby yarn, when drawn through the spindle, is rapidly twisted about the yarn's longitudinal axis by multiple rollers, called also "discs" thereby imparting a temporary high twist to the yarn, as a step in applying a permanent crimp to it.

False-twist texturing is a well known technique whereby a thermoplastic thread is overtwisted by various means and, through the action of heating and cooling, the deformation is stabilized before the thread is untwisted. Such twisting may be imparted by means of two or more overlapping multi-rim rollers having their axes parallel to one another, the overlapping portions of the multi-rim rollers imparting the temporary twist to the thread which passes across and against the peripheral edges of the rollers, the arrangement being such that the thread is deflected slightly from its normal direction of travel, as disclosed in Hilden U.S. Pat. No. 1,030,179. The yarn is unwound from a bobbin or spool by drawing it across the rollers (or into contact with other rotating surfaces) rotating substantially parallel to the direction of travel of the yarn across the rollers. Other systems have used parallel-running belts (in opposite directions) to impart such twisting to threads of yarn passing between the belts, as in Findlow U.S. Pat. No. 3,021,663. Regardless of the twisting medium used, the rotating surfaces have a coefficient of friction such as to twist the yarn without applying so much drag as to affect the orientation of the fibers making up the yarn.

By the Hilden process, the thread passes across the edges of only two overlapping rollers spinning the same direction. More recent devices have used three or more rollers, preferably three rollers located equidistant from one another (as on the vertices of an equilateral triangle, if the rollers were considered to be in one plane), such that the rollers' peripheral edges, when viewed along the axis central to the rollers and parallel to the axes about which the rollers rotate, form the vertices of an equilateral triangle, the rollers either having some distance between their peripheral edges in this central area, or overlapping somewhat. See, for example, Tully U.S. Pat. No. 2,923,121, disclosing a three-roller apparatus wherein the location of one of the rollers is adjustable to account for varying coefficients of friction of the rollers, and varying diameters of thread.

Because of the problems involved in adjusting the space between the rollers by movement of only one set of rollers, more recent systems, including that on which the subject invention is used, allow for adjustment of the distances between the rollers by movement of all three sets of rollers, rather than just one, as in Tully. See, for example, Schuster et al British Pat. No. 1,376,272, disclosing a system for making all the roller sets simultaneously and symmetrically adjustable, so that the rollers always lie at the vertices of an imaginary equilateral triangle, through the center of which runs the thread of yarn. Such a system eliminates the disadvantage in Tully of creating an isosceles triangle roller configuration (rather than the desired equilateral configuration) by movement of only one roller for adjustment purposes.

All of the above systems involving overlapping rollers have, however, the further disadvantage of difficulty of threading the yarn through the rollers. To do that, one or more of the sets of rollers are commonly moved aside, as by a hinge apparatus in Tully, allowing one set of rollers to pivot away from the others about a hinge axis parallel to the roller axes, so that the yarn may be threaded by hand between the two remaining rollers. The thread is generally passed through an orifice from a guide tube through which the thread runs, from there, between the displaced rollers, and finally through an exit guide on the other side of the rollers. The hand-threading method is incompatible with an integrated spin-texturing process in which, after a thread is spun by continuous extrusion, the thread is textured after or simultaneously with the thread-twisting in a continuous, integrated operation. The removed roller is then replaced in position so that the spindle may be operated. The Schuster system is operated by disengaging all threee roller sets, moving them aside, then moving them back in place for yarn twisting after the yarn has been threaded by hand through the area between the rollers.

The primary disadvantage of these systems is the time and difficulty involved in hand threading the rollers. A solution to this problem, provided by the subject invention, is a system eliminating the need to thread by hand the yarn through the displaced rollers.

SUMMARY OF THE INVENTION

This invention is an automatic threading system for use with false-twist spindles. The invention is most commonly used in a false-twist texturing spindle having several rollers revolving normal to the direction of travel of the yarn across the rollers. A guide tube parallel to the axes of the rollers, and hence normal to the rollers themselves, is provided for the yarn to be pushed through and/or drawn into the spindle. The guide tube has an opening just below the lowermost rollers, and is located such that its axis lies essentially through the median point of the configuration formed by the rollers when viewed along the direction of travel of yarn, and hence, normal to the rollers' rotating surfaces. Adjustment means is provided for displacing the rollers for the threading operation, and for positioning them for twisting operation.

The automatic threading operation is accomplished by means of a retractable tube which is longitudinally movable through a supqort mounted above the rollers, on an axis coincident with the axis of the guide tube. The retractable tube is movable from an inoperative spindle mode, in which the yarn may be threaded, to an operative spindle mode after threading. Threading is accomplished by one or more pneumatic guns which blow and draw the thread through the retractable tube, and hence, between the displaced rollers. In the operative mode, the spindle may be engaged for yarn twisting as the retractable tube is raised clear of the rollers. In the inoperative mode, the retractable tube is lowered into the area between the rollers, which are spread apart for threading by the roller displacement and adjustment means.

The retractable tube has thread guiding eyelets, typically ceramic guides, and the tube may be secured in place by a lock screw. The lower guide tube also has at each end a ceramic guide or eyelet. At its upper end, the guide tube also has an adjustable guide ring. The lower end of the retractable tube conforms closely to the upper end of the guide tube.

DESCRIPTION OF THE PREFERRED EMBODIMENTS

The invention constitutes an improved method for threading the yarn through the presently used false-twist texturing spindle, referred to hereinafter as simply a spindle. The spindle with which the subject invention is used in the preferred embodiment has three rollers, as spindles typically do, although the subject invention could be operated with more than three.

Specifically, the invention compries a guide tube which is dropped into position when each of the three rollers is displaced somewhat (for threading) from the central area through which the yarn passes, thereby allowing the yarn to be automatically, by a pneumatic system, drawn through the guide tube, and in turn, through the spindle. After the thread is drawn between the rollers and wound onto a bobbin on the exit side of the rollers, the tube is withdrawn and the rollers are replaced in position by the operation of a lever, which also reengages the rollers for the twisting operation. Such a procedure eliminates the time consuming and difficult task of hand threading the yarn between the spindles.

Figure 1:
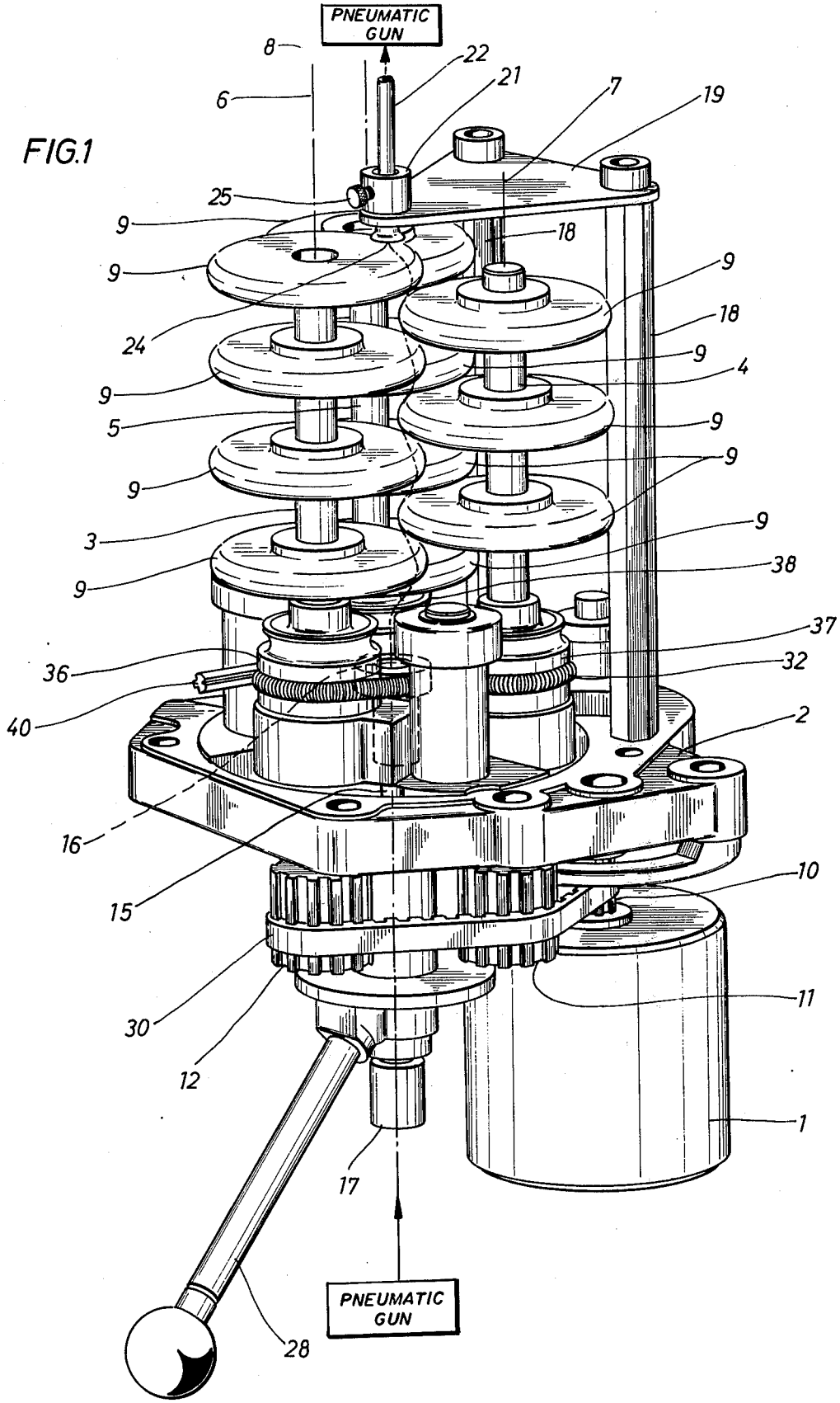
FIG. 1 is a pictorial representation of a three-roller false-twist texturing spindle apparatus.

FIG. 1 illustrates the entire false-twist texturing spindle apparatus, the complete structure and operation of which will be described for illustrative purposes. The spindle is designed to be mounted on the frame of a false-twist texturing machine, each processing position of the texturing machine to include a spindle. The spindle is driven by the texturing machine, which imparts its power via the driving roller 1. The driving roller 1 drives the pinion gears 11 and 12 (a third pinion gear referred to here as 10 is hidden from view) by means of a belt 30. An idler puller (also hidden from view) is provided for adjustment of the tension of the belt 30. The pinion gears 10, 11 and 12 rotate, with suitable bearings, on axles 8, 7 and 6 respectively. The pinion gears 10, 11 and 12 drive the bushings 5, 4 and 3 respectively, about axles 8, 7 and 6, respectively. The driving roller 1 and the axles on which the bushings and pinion gears rotate are mounted to a base plate 2. The axles 6, 7 and 8 are located on the vertices of an imaginary equilateral triangle, the center of which lies in the axis of the center of the spindle unit, through which the yarn passes during normal operation.

The pinion-bushing assemblies are secured in place for normal operation by a wrap-around spring 32, running tightly about all three bushing pulleys 36, 37 and 38. This spring is important to provide tension to maintain the bushings 6, 7 and 8 in place for normal operation. In order to spread the bushings apart for insertion of the yarn, some means of adjustment, such as an eccentric cam (not shown here) of the sort disclosed in French Pat. Nos. 2,176,826 and 2,225,554, is provided in the adjustment assembly actuated by handle 28. The cam also adjusts the distance between the bushings. Additional adjustment is possible via the control spacer 40.

Figure 5:
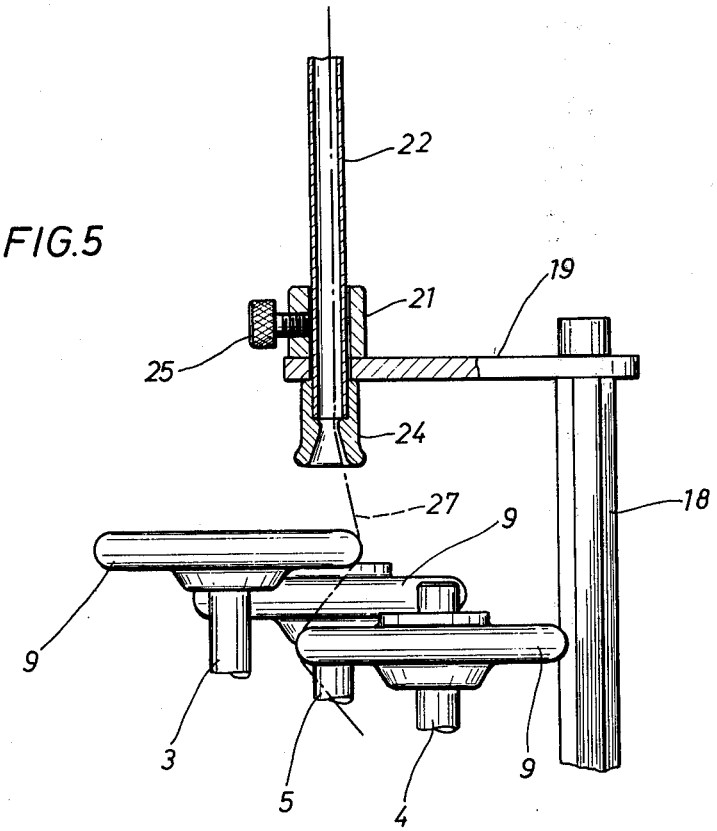
FIG. 5 shows the detail of three rollers on the three bushings in place, their overlapping orientation being slightly exaggerated to illustrate the direction of thread passing between them during the spinning process.

Mounted on the bushings 6, 7 and 8 are multiple rollers 9, which, in normal operation, overlap to a very slight degree, depending on the thickness of the yarn being twisted. The arrangement of the rollers in such that, by their overlap, the yarn is deflected slightly from its normal direction of travel by the intrusion between the rollers, so that intimate, though not excessive, contact is maintained between the yarn and the rollers. The rollers are fixed on the bushings 6, 7 and 8 so that they will be spaced, vertically and slightly apart, such that the thread will be twisted by the rollers as it is drawn across them at high speed. The overlap of the rollers 9 is illustrated in FIG. 5, which shows the overlap in a slightly exaggerated fashion for purposes of illustrating the zig-zag direction of yarn travel.

Figure 2:
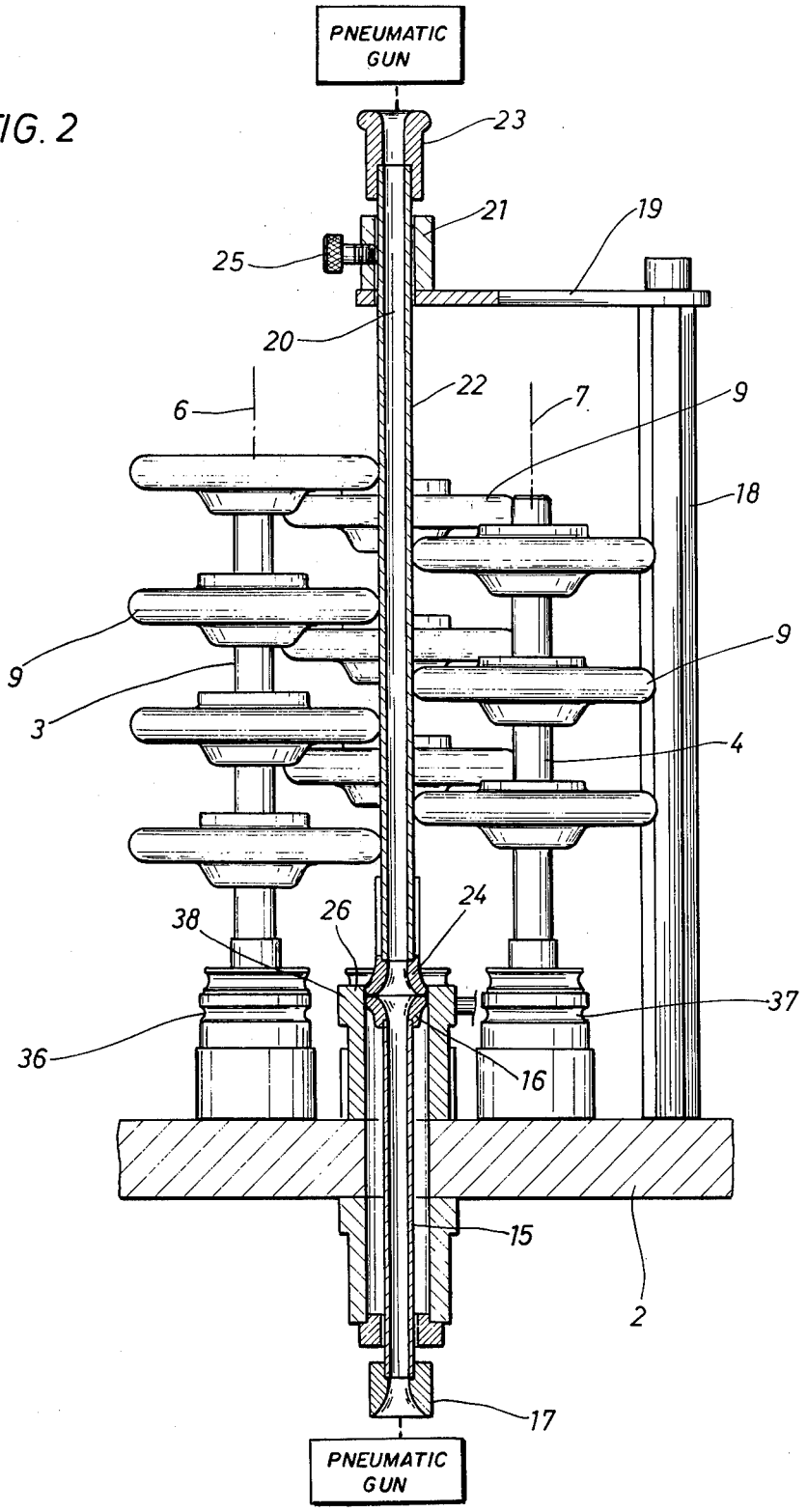
FIG. 2 is a partial longitudinal section of the appararus shown in FIG. 1, the central tube 22 and the base plate being shown in section, but the rollers not being sectioned.
Figure 4:
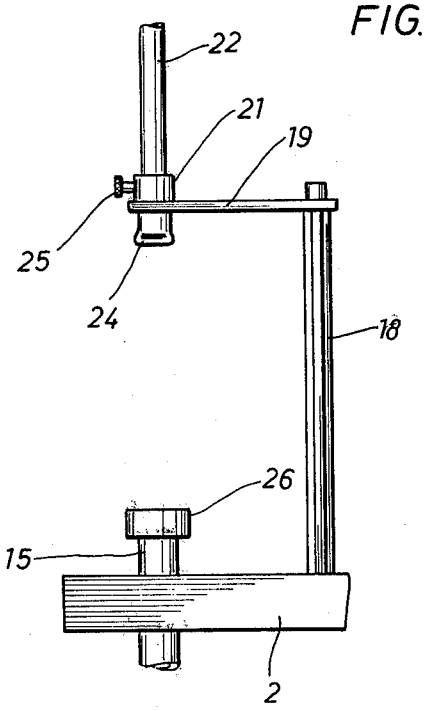

In FIG. 2, the axles 6, 7 and 8 are shown not overlapping, as there is enough space for the tube 22 (shown in section) to remain in place between them. During normal operation, the longitudinally movable or retractable tube 22 is raised upward, as shown in FIGS. 1 and 4. As long as the size of the passage between the rollers 9, as viewed along the axis of travel of the yarn, is less than the diameter of yarn, there will be some contact between the yarn and the edge of the roller 9. The closer together are the bushings 3, 4 and 5, and in turn the rollers 9, the more contact between the yarn and the edges of the rollers. FIGS. 1 and 5 illustrate the condition of substantial overlapping between the rollers 9, such that the zig-zag pattern of the thread 27 is shown. In such a case, there is no visible thread passage between the rollers 9.

The rollers 9 may be made of elastic material, plastic, steel, ceramic, or elastic-ceramic material such as that described in French Pat. No. 2,217,446, or other suitable materials. The shape of the rollers may also vary somewhat, although the rollers in the spindle illustrated have a semicircular peripheral shape as shown in FIGS. 2 and 5. It may be desirable for some rollers to have a slightly flatter curve for purposes of exposing more of each roller to the yarn, depending on the speed of travel and thickness of the yarn, and the distance between the three sets of rollers.

As explained above, the yarn 27 is threaded between the rollers 9 for twisting purposes. In order to accomplish this threading step, the rollers must be displaced somewhat by the cam so that there will be adequate space through which to easily draw the thread. To avoid hand threading, the subject invention provides an automatic means of threading the yarn. The line of travel of the thread is illustrated in FIG. 1, as the thread enters the spindle from below, through the ceramic guide 17, is drawn up through the upper ceramic guide 16, further up between th rollers 9, to the ceramic guide 24, and out through the retractable tube 22, which is held in the raised position by the lock screw 25 in the cylindrical guide 21. The guide 21 is mounted in a support plate 19, which is in turn secured to the base plate 2 by means of support rods 18. The center of the cylindrical guide 21 lies on the central axis of the spindle, coincident with the axis of the guide tube 15 and lower ceramic guides 16 and 17, and hence, with the direction of thread travel. The guide tube 15 is slightly below the lowermost rollers 9.

Figure 3:
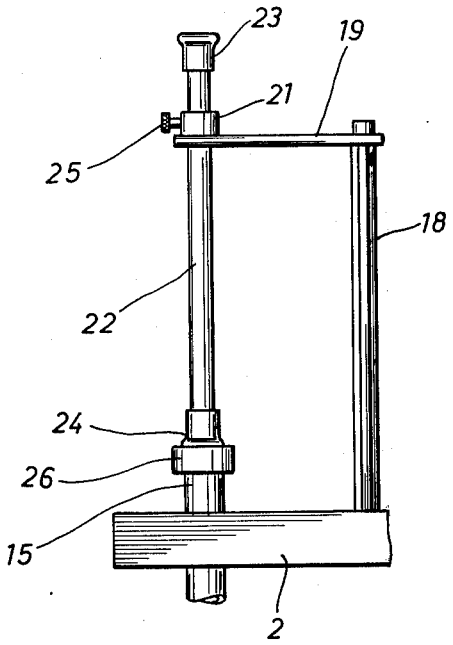
FIGS. 3 and 4 show the tube 22 in lowered and raised positions, respectively. The rollers, gears, and driving apparatus are not shown in FIGS. 3 and 4.

In FIG. 2, the retractable tube 22 is in the lowered position, the ceramic guide 24 being against the adjustable guide ring 26 (see also FIGS. 3 and 4). In normal operation or the operative mode, with the retractable tube 22 raised up, the rollers 9 would be closer together for yarn twisting, and the tube 22 would be in the raised position. In the ordinary threading configuration or inoperative mode, the tube 22 would be lowered, as shown in FIG. 2, but the rollers 9 would not be against the tube, as they would be further spread by the eccentric cam in order for the ceramic guide 24 to pass between the rollers 9 as the tube 22 is raised and lowered. When the retractable tube 22 is lowered against the ceramic guide 16 in the adjustable guide ring 26, rendering one spindle in its inoperative mode, the yarn may be threaded through the tube. This is accomplished by a pneumatic gun which aspirates the thread through ceramic guide 17, up guide tube 15, into retractable tube 22, and out the ceramic guide 23, for texturing or for attachment to a bobbin or other suitable thread accepting spool. A similr pneumatic gun helps draw the thread through tube 22, by being attached above ceramic guide 23, to pull the thread therethrough. The pneumatic gun attached above retractable tube 22 also has a thread cutter therein.

The guide tube 15 is thus provided with ceramic guides or eyelets 16 an 17 on both ends, above and below the base plate 2. Similarly, the retractable tube 22, which slides through the cylindrical guide 21, has ceramic guides or eyelets 24 and 23 on both ends. The retractable tube 22 may be of appropriate size and be made of any suitable material; in the preferred embodiment, it is stainless steel having dimensions of 4 mm inside diameter, 5 mm outside diameter, and 125 mm length.

Again, FIGS. 3 and 4 illustrate the lowered and raised positions of retractable tube 22 without showing the complications of the axles, rollers, pinion gears, and the driving roller. FIG. 5 shows, in slightly exaggerated fashion to illustrate the overlap of the rollers 9, the travel of the thread 27 up through the top three rollers, into the ceramic guide 24, and up retractable tube 22, out of which the thread is drawn for texturing or rolling on spools.

In operation, the invention is used to readily thread yarn through a spindle without the time consuming and old procedure of hand threading. The automatic threading procedure is as follows: The rollers are disengaged by removing power to them, by moving the driving roller 1 from the power source. The bushings 3, 4 and 5 are then separated by a quick movement of the lever 28, allowing the retractable rod 22, when screw 25 is released, to drop into position against the upper ceramic ring 16 on the guide tube 15. Pneumatic guns then aspirate and draw the thread up through the tube, for texturing or attachment to spools. After the thread has been drawn up, the retractable tube 22 is raised and locked in place and, by movement of the control lever 28, the bushings and rollers thereon are allowed to move back into place so that the spindle may be reengaged for twisting the thread as it is drawn through the spindle at high speed.

The invention thus provides a substantial contribution in the art of false-twist spindles by eliminating the old procedure of hand threading each time new yarn is run through the spindle. In view of the preceding description of a particular preferred embodiment, further modification and alternative embodiments of this invention may be apparent to those skilled in the art. Accordingly, the preceding description is to be construed as explanatory and illustrative only, and is for the purpose of teaching and enabling those skilled in the art to make and use the invention. The preferred embodiment of the invention shown and described herein is to be understood to be the best mode presently contemplated, but is by no means the only embodiment possible. Various changes may be made in the mere shape, size, or arrangement of parts. Equivalent elements or materials may be substituted for those illustrated and described herein, such as the stainless steel tube, and certain features of the invention may be utilized independently of the use of other features or of the spindle shown and described.

The scope of the invention is defined by the following claims, and also by all such equivalent modifications and variations that fall within the true spirit and scope of the invention.

What is claimed is:

1. In a false-twist texturing spindle having a support plate and a plurality of sets of rollers therein rotating about parallel axes normal to said support plate and overlapping with each other, a guide tube parallel to the axes of said rollers, opening just below the lowermost rollers and having its axis essentially at the median point of the configuration formed by said rollers, adjustment means allowing for displacement and positioning of said rollers, the improvement comprising a retractable tube, longitudinally movable through a support mounted above said rollers, on an axis coincident with said guide tube's axis and parallel with the axes of said rollers, from an inoperative mode adjacent the guide tube allowing yarn threading, to an operative mode after threading wherein the yarn passes through the interior of the retractable tube.

2. The spindle of claim 1, further including at least one pneumatic gun for threading yarn through said retractable tube.

3. The spindle of claim 1, wherein said retractable tube in said operative mode is displaced clear of said rollers.

4. The spindle of claim 1, wherein said retractable tube has thread guiding eyelets.

5. The spindle of claim 1, further comprising a lock screw on said support, wherein said retractable tube may be secured in place by said lock screw.

6. The spindle of claim 1, wherein said guide tube has at its upper end an adjustable guide ring and eyelet therein.

7. The spindle of claim 1, wherein the lower end of said retractable tube conforms closely to said upper end of said guide tube.

8. In a false twist texturing spindle unit of the type having at least three driven parallel axles symmetrically disposed about a median axis defining the central axis of the spindle, each said axle being provided with at least one rotationally symmetric frictional twisting disc whereby said discs overlap said central axis in an operative mode to supply twists to the yarns passing therealong and said axles being outwardly movable in a threading mode and said unit having means for supplying yarn to the spindle area and means for taking up yarn after the false twist operation, the improvement comprising a first fixed guide tube colinear with said central axis and providing a tubular path for introducing yarn into the spindle unit and terminating in a mouth portion proximate one end of said discs, a second linearly retractable guide tube colinear with said central axis and having a length at least as long as the portion of said axles incorporating said discs and being selectably positionable in either a retracted operating position wherein the yarn passes through the retractable tube after engagement with said discs or in a threading position wherein the terminal end portion of the retractable tube is moved into communication with the mouth of said fixed tube for establishing a substantially uninterrupted tubular path along the central axis of the unit, and means for propelling yarn through said first and second tubes during the threading mode.

9. A spindle unit as claimed in claim 8 having exactly three axles wherein said axles are located on the vertices of an equilateral triangle, the center of which lies in the central axis of the spindle unit.

10. A spindle unit as claimed in claim 8 wherein said means for propelling comprises pneumatic gun means for moving the yarn through said first and second tubes.

11. A spindle unit as claimed in claim 10 wherein said pneumatic gun means comprises a first gun communicating with said first tube and operable to aspirate the yarn and a second gun communicating with said second tube and operable to pull the yarn therethrough.

12. A method of operating a false twist texturing spindle unit of the type having at least three overlapping rotary discs arranged on parallel axes disposed about a central axis defining the yarn path and having means for feeding yarn upwardly along the path from a lower guide and having means for taking up yarn above the discs, said method comprising the steps of displacing the discs outwardly to provide an unobstructed path along the central axis to the spindle unit, lowering a tubular member having a central opening aligned with the central axis from a position above the discs to a position where the lower end of such tubular member communicates with the lower guide, with the tubular member in the lowered position threading the spindle unit by passing thread from said lower guide upwardly through the tubular member and into operative association with the means for taking up the twisted yarn, after threading the unit retracting the tubular member along a linear path to a position above the discs, repositioning the discs in an operative overlapping relationship, and advancing yarn along the yarn path for imparting a false twist to such yarn and onward through the tubular member to said means for taking up.

13. A method as claimed in claim 12 wherein said threading step is performed by operating pneumatic gun means communicating with the passage defined by the tubular member and the lower guide to propel the yarn therethrough.

14. A method as claimed in claim 13 wherein said pneumatic gun means comprises a first pneumatic gun below the lower guide and operable to aspirate the yarn upwardly therethrough and a second pneumatic gun above said tubular member and operable to exert a pulling force on the yarn.

* * * * *